United States Patent [19]

Kozai et al.

[11] 3,966,018

[45] June 29, 1976

[54] WORKING PLATFORM LIFTING APPARATUS FOR AERIAL LADDER TRUCK

[75] Inventors: Tetsuo Kozai, Higashiosaka; Shomitsu Shiraki, Osaka, both of Japan

[73] Assignee: Morita Pump Kabushiki Kaisha, Osaka, Japan

[22] Filed: Feb. 12, 1975

[21] Appl. No.: 549,299

[52] U.S. Cl. ..... 182/103; 182/18; 182/19; 182/66

[51] Int. Cl.[2] ..... A62B 1/00

[58] Field of Search ..... 182/103, 102, 101, 18, 182/19, 141, 142, 66; 187/10, 9 R

[56] References Cited

UNITED STATES PATENTS

| | | | |
|---|---|---|---|
| 2,198,071 | 4/1940 | Artini | 182/103 |
| 2,894,605 | 7/1959 | Leavitt | 182/103 |
| 3,693,755 | 9/1972 | Terayama | 182/102 |

*Primary Examiner*—Reinaldo P. Machado
*Attorney, Agent, or Firm*—Hall & Houghton

[57] ABSTRACT

A working platform lifting apparatus for an aerial ladder truck, wherein the working platform movable up and down along the ladder is arranged so that it does not interfere with the extension and contraction of the ladder, that when it is stopped at any desired position it is automatically braked, that when it reaches its uppermost position it is automatically stopped and that in an emergency it can be lowered manually. Other merits and details of the construction will be made clear.

5 Claims, 10 Drawing Figures

WORKING PLATFORM LIFTING APPARATUS FOR AERIAL LADDER TRUCK

BACKGROUND OF THE INVENTION a. Field of the Invention

The present invention relates to a working platform lifting apparatus for an aerial ladder truck for fire fighting purposes used for operations at high altitudes, for example, for extinguishing a fire in a multistory building or for saving a person who has been left behind the scene of a fire.

b. Description of the Prior Art

Heretofore, an aerial ladder truck equipped with a working platform movable up and down along the extensible ladder has been known in the art. The conventional aerial ladder truck of this type, however, has the disadvantage that the extending and contracting operation of the ladder and the raising and lowering operation of the working platform interfere with each other. As a result, the operations and mechanisms of the ladder and working platform are very complicated. Further, in a safety aspect of the working platform, there are problems which must be solved.

SUMMARY OF THE INVENTION

The present invention is intended to make the extending and contracting operation of the ladder and the raising and lowering operation of the working platform free from interference with each other. Further, even if the driving system for the working platform goes wrong, the platform can be manually raised or lowered.

DESCRIPTION OF THE PREFERRED EMBODIMENT

Figure 1:
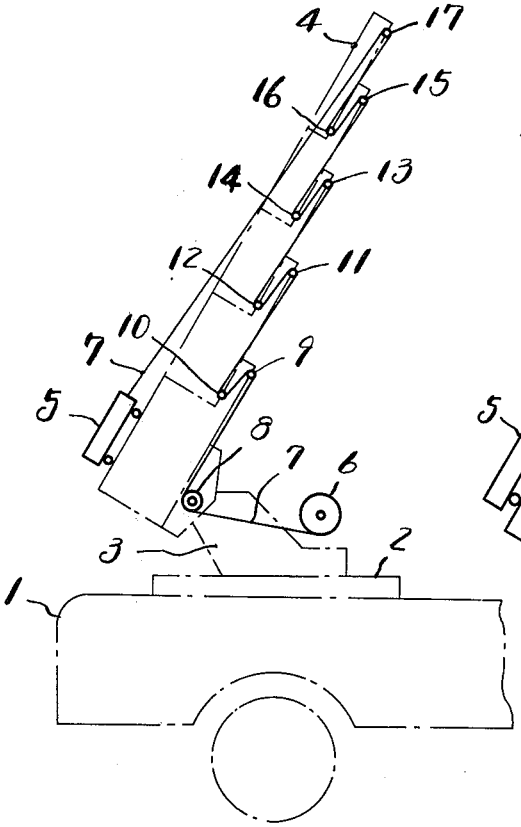
FIG. 1 is a schematic side view of the entire apparatus of the present invention.

In FIG. 1, the character 1 designates an aerial ladder truck; 2, a turntable; 3, a ladder supporting structure set up on the turntable 2; and 4 designates a ladder equipped with means whereby it is extended and contracted and means whereby it is vertically swung.

A winch 6 is mounted on the turntable 2 and a wire 7 withdrawn from the winch extnds in zigzags passing successively around a pulley 8 mounted on a ladder pivot, a pulley 9 at the front end of the first ladder section, a pulley 10 at the rear end of the second ladder section, a pulley 11 at the front end of the second ladder section, a pulley 12 at the rear end of the third ladder section, a pulley 13 at the front end of the third ladder section, a pulley 14 at the rear end of the fourth ladder section, a pulley 15 at the front end of the fourth ladder section, a pulley 16 at the rear end of the fifth ladder section and a pulley 17 at the front end of the fifth ladder section, the front end of said wire being tied to the working platform 5. In addition, for a ladder having six or more ladder sections, the wire 7 may be likewise arranged.

Because of the arrangement of the wire 7 described above, the extension and contraction of the ladder 4 will not cause the working platform 5 to be raised or lowered. This will now be described in more detail with reference to FIG. 2.

Figure 2:
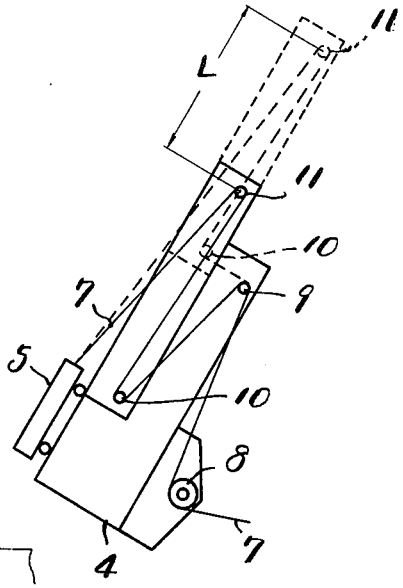
FIG. 2 is a view explanatory of operation.

Referring to FIG. 2 illustrating the relation between the first and second ladder sections, if the second ladder section is extended through a distance L, the pulleys 10 and 11 will be displaced also through the same distance L. As a result, the distance between the pulleys 10 and 11 is decreased by the same amount L. On the other hand, the distance between the pulley 11 and the working platform 5 is increased by the same amount L. The net result is that without the wire 7 changing in length or being paied out, the ladder alone is allowed to extend or contract while holding the working platform 5 in its stopped position. It will be apparent that the ladder can be likewise contracted. The same applies to a ladder having three or more ladder sections.

After the ladder 4 is extended, the working platform 5 may be raised or lowered.

Figure 3:
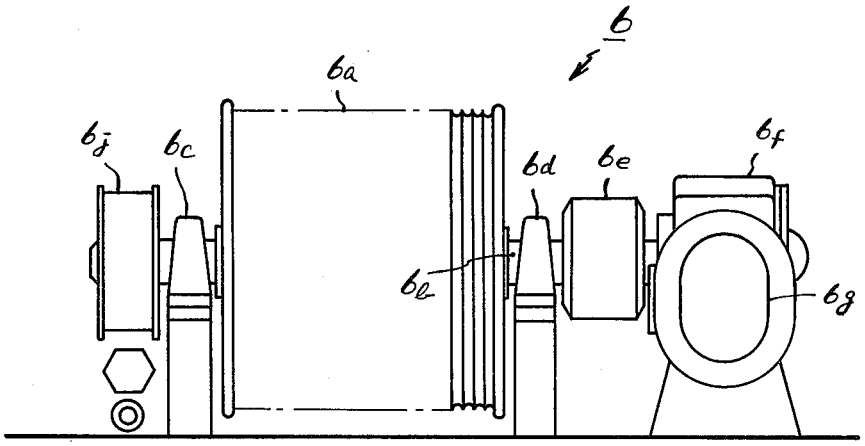
FIG. 3 is a front view of a winch.
Figure 4:
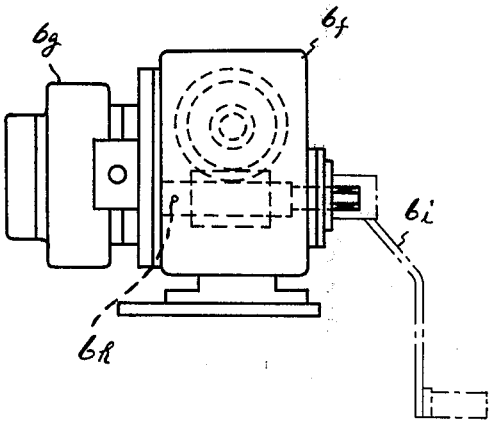
FIG. 4 is a right-hand side view of FIG. 3.

As shown in FIG. 3, the winch 6 comprises a winding drum **6*a* having a shaft 6*b* rotatably supported in bearings 6*c* and 6*d*, one end of said shaft 6*b* being connected to a worm gear speed reduction mechanism 6*f* through a coupling 6*e*, said mechanism being connected to a hydraulic motor 6*g*. The input shaft 6*h* of the worm gear speed reduction mechanism 6*f*, as shown in FIG. 4, is connected at one end thereof to the hydraulic motor 6*g* and is adapted to receive a handle 6*i* which may be used to manually rotate the wire winding drum 6*a* to wind or unwind the wire to raise or lower the working platform 5 in the event of a breakdown occurring to the hydraulic circuit of the motor 6*g***.

Figure 5:
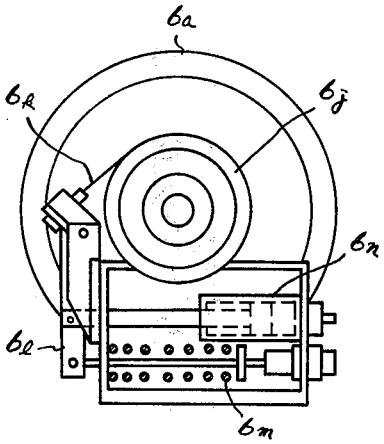
FIG. 5 is a left-hand side view of FIG. 3.

As shown in FIG. 3, a brake drum **6*j* is connected to the other end of the wire winding drum 6*a*. The brake drum is provided with a band 6*k*, as shown in FIG. 5. One end of the brake band is fixed in position, while the other end is connected to a movable arm 6*l* to which a brake applying spring 6*m* and a brake removing hydraulic cylinder 6*n* are connected. As will be later described, it is so arranged that when the working platform 5 is raised or lowered, the brake is removed in connection with such raising or lowering operation and that when the working platform is brought to a stop, the hydraulic cylinder 6*n* becomes inactivated, allowing the brake applying spring 6*m* to brake the brake drum 6*j*. The brake is especially designed to be effective on the lowering side of the working platform 5**.

Figure 6:
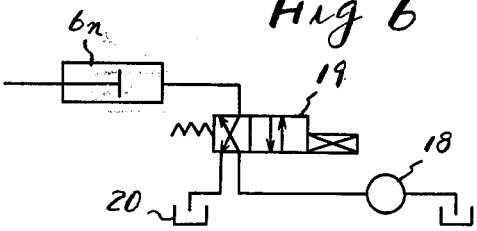
FIG. 6 is a view of a hydraulic circuit for a brake removing hydraulic cylinder.

FIG. 6 shows the hydraulic circuit of the brake removing hydraulic cylinder **6*n*. Thus, the cylinder 6*n* is supplied with high pressure working oil from a hydraulic pump 18 through a solenoid valve 19. When the solenoid valve 19 is not energized, the hydraulic cylinder 6*n* is not supplied with oil and communicates with an oil tank 20**, allowing the piston to move freely in the cylinder.

Figure 7:
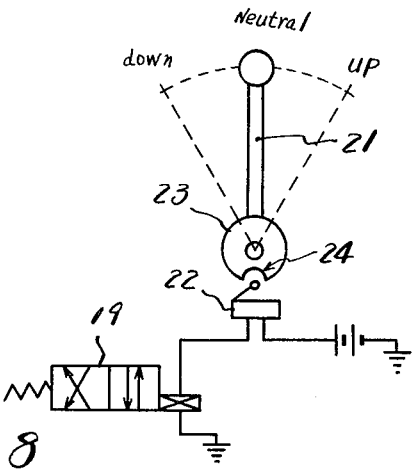
FIG. 7 is a view of control means for the solenoid valve shown in FIG. 6.

As shown in FIG. 7, the solenoid valve 19 is placed in an electric circuit to a switch 22 which is on-off controlled by the operation of an operating lever 21 for raising or lowering the working platform. Thus, the lever 21 is provided with a cam 23 opposed to said switch 22 and having a recess 24, the arrangement being such that when the lever 21 is in its neutral position, the recess 24 is opposed to the switch 22 to open the latter and that when the lever is moved to its raising or lowering position, the switch 22 is closed.

With the arrangement described above, when the working platform 5 is raised or lowered, the solenoid valve 19 is energized, whereby the brake removing hydraulic cylinder 6*n* slackens the brake band 6*k*. Further, means is provided whereby when the working platform 5 reaches its uppermost position, the operating lever 21 is automatically brought back to its neutral position, as will be described below.

Figure 8:
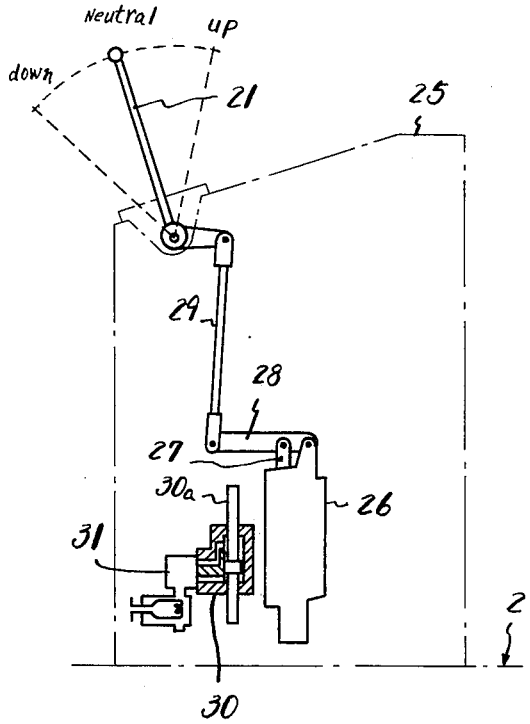
FIG. 8 is a side view of a mechanism for raising and lowering a working platform.

As shown in FIG. 8, the operating lever 21 is installed in a control tower 25 mounted on the turntable 2. Also installed in the control tower 25 is an operating valve 26 having a spool 27 connected to a lever 28. The levers 21 and 28 are interconnected by a link 29. The operating valve 26 serves to control the hydraulic circuit of the hydraulic motor 6*g* of the winch 6 shown in FIGS. 3 and 4.

Figure 9:
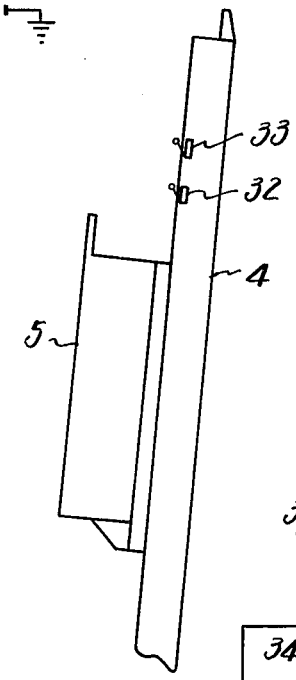
FIG. 9 is a fragmentary side view of a ladder showing the uppermost section thereof.
Figure 10:
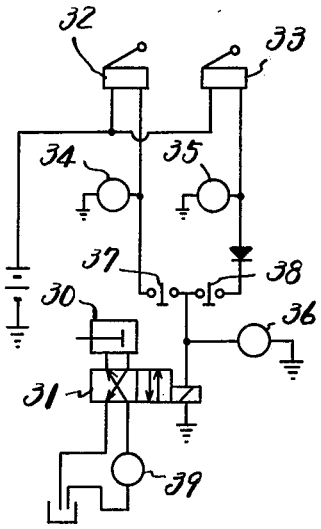
FIG. 10 is a view of an electric circuit for automatic stop means associated with said uppermost ladder section.

Positioned close to said operating valve 26 is an automatic stopping hydraulic cylinder 30 which is controlled by a solenoid valve 31 which, in turn, is on-off controlled by limit switches 32 and 33 positioned at the front end of the ladder 4 (see FIG. 9). The limit switches 32 and 33 are adapted to be closed when the working platform 5 reaches its uppermost position. The electric circuit of the solenoid valve 31 is arranged in the manner shown in FIG. 10, comprising pilot lamps 34 and 35, a buzzer 36 and manual switches 37 and 38 which are normally closed. In this condition if the working platform 5 is raised and approaches the front end of the ladder 4, the lower limit switch 32 is closed, whereby the pilot lamp 34 is lit and the buzzer 36 is rung while the solenoid valve 31 is energized. As a result, the solenoid valve 31 is switched so that working oil from a pump 39 is fed into one of the chambers of the hydraulic cylinder 30. This condition corresponds to the lower chamber of the hydraulic cylinder 30 being filled with working oil in FIG. 8. Therefore, the piston rod 30*a* of the hydraulic cylinder 30 is upwardly moved to push up the lever 28 so that the operating lever 21 is shifted from its raising position back to its neutral position. As a result, the operating valve 26 is shifted to its neutral position to stop the upward movement of the working platform 5. The stoppage of the working platform 5 at its uppermost position is effected in two steps. Thus, the first step takes place at its usual uppermost position and the second step is taken only when it is desired to further raise the working platform 5 beyond said position. If the limit switch 32 at the first step is closed, the working platform 5 is automatically stopped. In this condition, if it becomes necessary to further raise the working platform, this may be achieved by opening the manual switch 37 shown in FIG. 8 and then shifting the operating lever 21 shown in FIG. 8 to its raising position. As a result, the working platform 5 is raised until it closes the limit switch 33 at the second step, whereupon the solenoid 31 and the buzzer 36 are energized and the working platform is automatically stopped.

Since the operation of the working platform 5 described above is controlled at the control tower 25, it would be difficult to ascertain whether the working platform reaches its uppermost position. To overcome this difficulty, the automatic stop mechanism has been employed only at the uppermost position of the working platform.

The automatic stopping hydraulic cylinder 30 does not interfere with the operation of the operating lever 21 to its lowering position.

As has been described thus far, according to the present invention, the ladder and the working platform can be operated independently of each other and their operations and mechanisms can be greatly simplified. Further, since the working platform can be automatically stopped at its uppermost position, the safety is high as compared with a system in which the operator has to ascertain such stoppage visually. Since the brake is automatically applied whenever the working platform is stopped, safety is assured, at whatever position along the ladder the working platform may be stopped. Particularly, since the brake acts more effectively on the lowering side of the working platform, the safety is further increased. Moreover, even if an accident occurs to the hydraulic drive system of the working platform, it is still possible to raise or lower the working platform by means of a handle.

Whiles there have been described herein what are at present considered preferred embodiments of the several features of the invention, it will be obvious to those skilled in the art that modifications and changes may be made without departing from the essence of the invention.

It is therefore to be understood that the exemplary embodiments thereof are illustrative and not restrictive of the invention, the scope of which is defined in the appended claims and that all modifications that come within the meaning and range of equivalency of the claims are intended to be included therein.

What is claimed is:

1. The combination in an aerial ladder truck of a turntable mounted on and adjacent the rear end of the truck, a ladder supporting structure mounted on the turntable, extensible and contractable ladder means mounted on said ladder supporting structure, said ladder means including a plurality of longitudinally movable ladder sections, pulley means mounted at the front and rear ends of the successive ladder sections, working platform means mounted on said ladder means for movement longitudinally along the ladder sections after said sections of the ladder means have been extended, winch means mounted on said turntable for extending and contracting the ladder sections of said ladder means and raising and lowering the working platform member only after the ladder sections have been placed in an extended or contracted state, cable means mounted at one end to said winch means and thereafter passed in zig zag arrangement successively around each of the front and rear mounted pulley means of each ladder section of said ladder means with the opposite end of said cable means being connected to said working platform means, hydraulic motor means operatively connected to said winch means for extending or contracting the ladder sections and to raise or lower the working platform means only after the ladder sections have been first placed in an extended or contracted state, braking means for said winch means to stop the rotation of said winch means, actuating means for actuating said hydraulic motor means, and electrical circuit means between said actuating means and said hydraulic means, said electrical circuit means including first solenoid means for energizing the braking means of said winch means when the actuating means are in a neutral position and second solenoid means having switch means energized by said working platform means to place the actuating means in a neutral position when the platform means has reached the desired uppermost limit on said ladder means.

2. The combination in accordance with claim 1, which further includes worm gear speed reduction means connected between said winch means and said hydraulic motor means, said reduction means including means to manually actuate said winch means.

3. The combination in accordance with claim 1, which includes means to automatically actuate said braking means when said working platform means is at a stopped position.

4. The combination in accordance with claim 1, which includes means to automatically stop the movement of said working platform means when it has reached its uppermost limit.

5. The combination in accordance with claim 4, which includes signal means being placed in operation when said platform has been automatically stopped.

* * * * *